United States Patent [19]

Hirsch

[11] Patent Number: 5,005,269

[45] **Date of Patent: * Apr. 9, 1991**

[54] RESILIENT SPRING CLIP SHOULDER STRAP LOOP

[75] Inventor: Nathan A. Hirsch, Monsey, N.Y.

[73] Assignee: Albest Metal Stamping Corporation, Brooklyn, N.Y.

[ * ] Notice: The portion of the term of this patent subsequent to Jun. 26, 2007 has been disclaimed.

[21] Appl. No.: 513,822

[22] Filed: Apr. 24, 1990

Related U.S. Application Data

[63] Continuation of Ser. No. 734,156, May 15, 1985, Pat. No. 4,935,997.

[51] Int. Cl.[5] ..... A44B 11/00

[52] U.S. Cl. ..... 24/668; 24/666; 24/678

[58] Field of Search ..... 24/668, 666, 678

[56] References Cited

U.S. PATENT DOCUMENTS

| | | | |
|---|---|---|---|
| 1,346,911 | 7/1920 | Peterson | 24/668 |
| 1,775,101 | 9/1930 | Hodge | 24/668 |
| 1,798,146 | 3/1931 | Domkee | 24/668 |
| 1,824,547 | 9/1931 | Hodge | 24/668 |
| 1,831,804 | 11/1931 | Domkee | 24/668 |
| 1,832,191 | 11/1931 | Domkee | 24/668 |
| 1,844,282 | 2/1932 | Hodge | 24/668 |
| 1,844,283 | 2/1932 | Hodge | 24/668 |

*Primary Examiner*—Victor N. Sakran

*Attorney, Agent, or Firm*—Helfgott & Karas

[57] ABSTRACT

A spring clip closure member for resiliently fastening onto a button type projection, of the type typically used in suspenders, jeans, and other garments. The spring clip includes an inverted U-shaped resilient wire loop having a bight portion for suspension form the garment. A pair of opposing leg portions each terminate in inwardly directed feet with downwardly directed fingers. The fingers are resiliently separable but are normally biased toward each other. An encasement member envelopes the feet portions and includes a closed pocket for receiving and enveloping depending finger portions. The finger portions can laterally move within the closed pocket so as to engage and release the button type projection. Lateral apertures are provided in the encasement member through which the feet portions extend during a closure operation.

7 Claims, 2 Drawing Sheets

RESILIENT SPRING CLIP SHOULDER STRAP LOOP

This is a continuation of Ser. No. 734,156, filed May 15, 1985, now U.S. Pat. No. 4,935,997.

BACKGROUND OF THE INVENTION

This invention relates to resilient clips, and more particularly to a spring clip which engages a button type projection to form a fastening device.

In various fields, especially the clothing industry, there are numerous types of fastening devices that are utilized. One such fastening device used with suspenders, jeans, or the like, includes a spring clip which resiliently engages a button projection. By way of example, the spring clip would depend from the bottom of a suspender strap. A button having a reduced dimensioned neck portion would be connected onto the trousers. The resilient clip engages onto the button with the clip tightly grasping the reduced neck portion.

When using such fasteners, it is frequently necessary to engage and disengage the fastener when either removing the suspenders, opening the jeans, or undoing the various garments. Such frequent manipulation of the resilient clip requires continuous interaction by the user's fingers. It is therefore necessary that the spring clip be adequately protected to avoid sharp edges which scratch, cut, or in any way harm the user during such manipulation.

Additionally, since the spring clip forms part of a garment, it is desirable to avoid having the spring clip become entangled with the garment, snagging of the garment as well as collecting dirt, debris, and the like in its various parts. This is especially of concern in spring clips which include portions which are resiliently biased together. In such clips there is a tendency of the biased portion parts to grasp the fabric, as well as collect dirt between the biased members thereby causing the spring clips to become dirty and often unsightly.

Accordingly, while the spring clip type of fastener has been utilized in the garment industry, it warrants further improvement to its construction clip in order to eliminate any sharp cutting edges that may be formed thereon as well as eliminating the ability of collecting debris, or snagging and ripping of the garments.

SUMMARY OF THE INVENTION

Accordingly, it is an object of the present invention to provide a spring clip for use as part of a closure member, which avoids the aforementioned problems of prior art devices.

Another object of the present invention is to provide a spring clip having an encasement portion which closes off the free ends of the spring clip.

Yet another object of the present invention is to provide a spring clip as part of a fastener member, and which includes an encasement portion covering the free ends thereof with the encasement portion being developed from a sheet of planar material having axial symmetry about a transverse axis.

Yet a further object of the present invention is to provide a spring clip type of fastener which has an encasement portion over the free ends thereof, which thereby eliminates sharp edges, and exposed gripping portions, to thereby improve the utilization of the spring clip. Briefly, in accordance with the present invention, there is provided a spring clip closure member of the type that resiliently clamps onto a button type projection. Such spring clips are typically formed of an inverted U-shaped resilient wire loop having a bight portion which may be suspended from a support band, such as a suspender strap and the like. The wire loop includes a pair of opposing leg portions. Each of the leg portions terminates in an inwardly directed foot portion having a downwardly directed finger portion. The foot portions are resiliently separable and normally biased toward each other so as to engage the buttom type projection. An encasement is included which envelopes the foot portions. The encasement includes a closed pocket at its lower end for receiving and enveloping the depending finger portions. The encasement is dimensioned so as to permit resilient lateral movement of the finger portions, although they are covered and enclosed within the pocket. Lateral apertures are provided in the encasement through which the foot portions can extend.

In an embodiment of the invention, the encasement is developed from an elongated planar sheet of rigid material which has symmetry about its transverse axis. Opposing ends of the planar sheet are contoured to define a U-shaped planar extension. An upwardly extending flange is formed along the perimeter of each of the contoured ends. The planar sheet is then folded about its transverse axis causing the flanges to matingly abut. The abutting flanges formed about the U-shaped extensions define the closed pocket.

The aforementioned objects, features, and advantages of the invention will, in part, be pointed out with particularity and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawing, like reference characters designate like parts.

DESCRIPTION OF THE PREFERRED EMBODIMENT

The spring clip of the present invention is of a type typically utilized in the garment industry, to fasten suspenders onto a garment. The clip resiliently engages a reduced neck portion of a button type projection.

Figure 1:
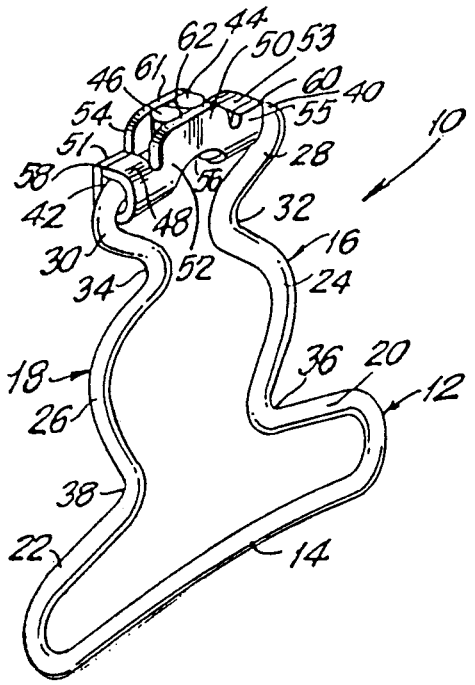
(PRIOR ART) FIG.1
FIG. 1 is a perspective view of a spring clip in accordance with the prior art, showing an encasement which is open exposing the distal ends of the spring clip, and having sharp edges which may cut the user or snag the garment.

A typical spring clip of the prior art is shown in FIG. 1, with the spring clip 10 including a substantially U-shaped resilient wire loop 12 having a horizontal bight portion 14, and a pair of opposing leg portions 16, 18. The leg portions 16, 18 include a first inwardly directed pair of arms 20, 22 extending from the lateral ends of the bight portion 14. The arms 20, 22 extending from the lateral ends of the bight portion 14. The arms 20, 22 continue into the double bowed, hourglass configuration of the arms 16, 18, including a first larger outwardly bowed section 24, 26 and a second narrower outwardly bowed section 28, 30. The two bowed sections have a narrow neck portion 32, 34 therebetween. The connections between the arms 20 and the bowed section 24, 26 also include reduced neck portion 36, 38. At the ends of section 28, 30, there are inwardly directed feet 40, 42, which terminate in projecting fingers 44, 46.

Because of the spring force of the bowed sections, the fingers 44, 46 are biased into a position normally abutting each other. However, the resiliency of the spring clip permits the fingers 44, 46 to be resiliently separable as opposing legs 16, 18 are spread apart The feet 40, 42, and the fingers 44, 46 are normally enclosed by an encasement, shown generally at 50. In the prior art, the encasement 50 is a substantially U-shaped saddle member having a pair of flat opposing side walls 52, 54 which sandwich the fingers 44, 46 therebetween. Laterally on either side of the flat side walls 52, 54 are a pair of tubular portions in which pass the feet 40, 42. The left tubular portions defined by an arcuate wall section 49, closed off by a flat wall section 51. Likewise the opposing tubular portion includes a arcuate wall section 53, closed off by the flat wall section 55. A notch 56 is formed at the head of the encasement and cooperates with the lower bowed arms 28, 30 in grasping the button type projection.

As can be noted from viewing the prior art spring clip of FIG. 1, the encasement 50 serves to protect the ends of the spring clip. However, the walls 52, 54 only serve in laterally protection of the fingers 44, 46. The distal ends of the fingers, 44, 46 are still exposed. As a result, as the fingers resiliently spread during the closure of the clip onto the button, they can grasp a portion of the garment and thereby snag the garment to which they are attached. At the same time, they may also grasp pieces of dirt, etc., from the surrounding garment area which will become entrapped between the fingers 44, 46 and will accumulate therebetween.

It is also noted, that the tubular side portions have sharp edges which can snag the garment, prick the user, or abrade the garment surface to which it is connected. For example, the corners 58 and 60, are sharp and can grasp or snag a garment. Similarly, the upper edges 61, 62 of the flat walls 52, 54 can also scratch and snag.

Accordingly, while the spring clip of the prior art has been quite effective, it requires improvement to eliminate the exposure of fingers 44, 46, and elimination of the various sharp corners, grooves, etc., which can snag, abrade the garment and may cut the user.

Figure 2:
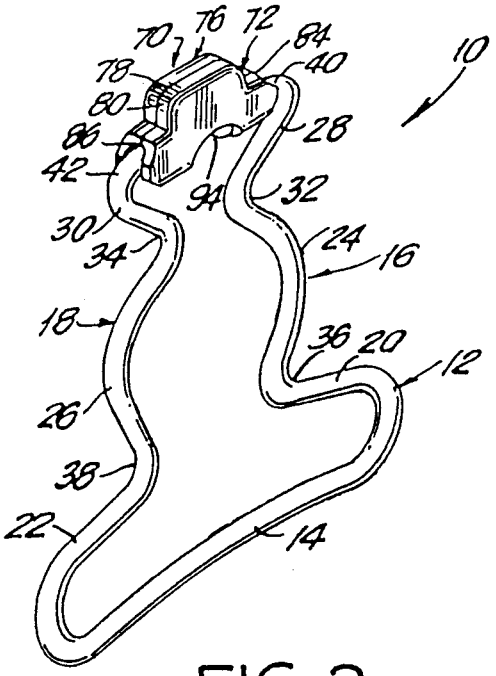
FIG. 2 is a perspective view similar to that shown in FIG. 1 and now showing the spring clip of the present invention with the novel encasement member enclosing the distal free ends and avoiding sharp edges.
Figure 5:
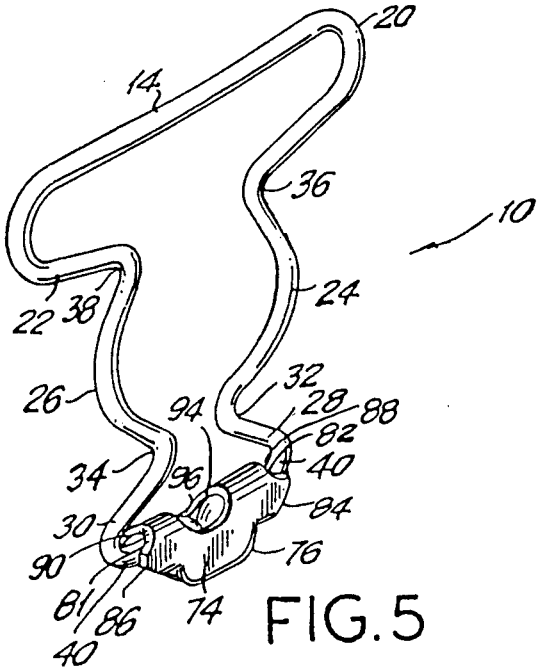
FIG. 5 is a perspective view of the novel spring clip shown in FIG. 2 and taken with the clip in its typical suspended position for operational use.
Figure 6:
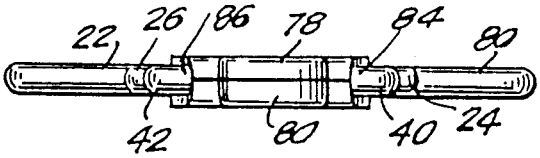
FIG. 6 is a bottom view of the spring clip shown in FIG. 5.

Referring now to FIGS. 2, 5 and 6, there is shown the spring clip 10, substantially identical as in the prior art, however, including a novel encasement member 70. The spring clip is formed as an inverted U-shaped loop member and, accordingly, all of the parts of the U-shaped loop identified as those shown in FIG. 1. It should be appreciated, that in its normal use, the spring clip would be suspended in the position shown in FIG. 5, with the bight portion 14 being connected to a suspender strap, or other support member.

The encasement 70 is shown to include a pair of side walls 72, 74 having an upper portion and a lower portion. The lower portion defines a substantially closed pocket 76 which completely envelopes the fingers 44, 46 preventing their exposure. The closed pocket 76 is defined by means of a pair of abutting U-shaped end walls 78, 80 which completely enclose the distal edges of its fingers. At the same time, it still permits the fingers to resiliently spread with respect to each other.

The upper portion of the encasement member 70 includes a pair of side apertures 81, 82 through which can pass the feet 40, 42 of the U-shaped wire loop. The apertures 81, 82 are formed within peripheral wall portions. However, a pair of notches 84, 86 are formed at one surface of the apertures 81, 82 and a corresponding pair of notches 88, 90 are formed on the opposing surface of the apertures 81, 82 to thereby eliminate the sharp edges and corners on the encasement member 70. This permits the spring clip to be utilized without fear of snagging or cutting a garment or harming the user. The upper portion also includes an arcuate notch 94 which cooperates with the lower bowed portion 28, 30 in grasping the button type projection. The walls 94 around the mouth of the notch 96 are smooth to again avoid any possibility of snags.

Figure 3:
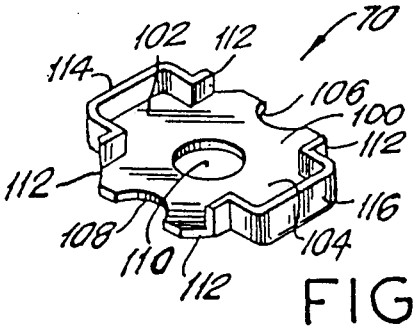
FIG. 3 is a view of one surface of the sheet from which the encasement member is developed.
Figure 4:
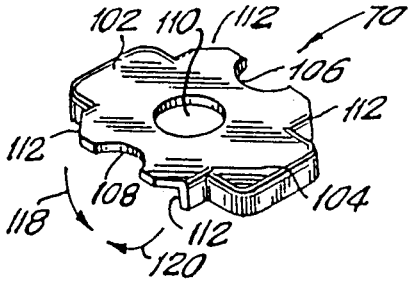
FIG. 4 is a perspective view of the opposing surface of the sheet shown in FIG. 3, and depicting the folding of the sheet about its transverse axis to form the encasement member.

As shown in FIGS. 3 and 4, encasement member 70 can be formed of a sheet having a substantially planar surface 100 of elongated configuration. The sheet 100 is symmetrical about a transverse axis formed thereacross. At opposing ends, the planar sheet 100 includes substantially U-shaped extension 102, 104 to provide contoured edges. The sides include arcuate notches 106, 108. The axis of notches 106, 108 are coaxial with the transverse axis through the member 70. A central aperture 110 is provided through the planar sheet 100. At each of the four corners 112 there are also formed angled corners. Upwardly projecting flanges 114, 116 are respectively formed at the perimeter of the ends of sheet 102. The flanges 114, 116 have a substantially U-shaped configuration corresponding with the contoured ends of the sheet 100.

The encasement member 70 is formed by bending the sheet 100 about its transverse axis, as shown by the arrows 118, 120 in FIG. 4. In so doing, the flanges 114, 116 will abut each other and define the closed pocket 76 which encases the fingers 44, 46 at the distal ends of the resilient clip. The angled corners 112 will define the notched portions 84, 86 about the apertures 81, 82. The side arcuate notches 106, 108 of the sheet 100 will define the notches 88, 90. The center aperture 110 will form the arcuate section 94 cooperating in the engagement of the button type projection.

Figure 7:
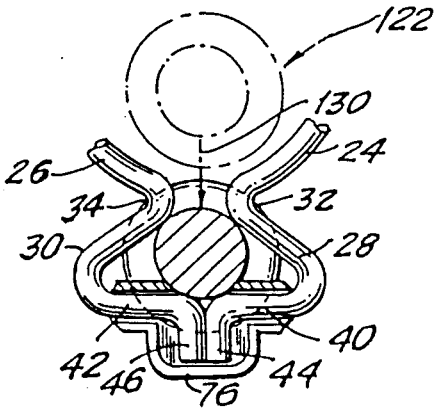
FIG. 7 is a partially sectioned view showing the engagement of the spring clip with the button type projection.
Figure 8:
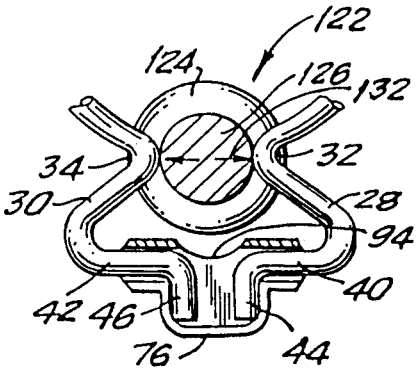
FIG. 8 shows a view similar to that shown in FIG. 7 and showing the spring clip in the process of such engagement.

Referring now to FIGS. 7 and 8, there is shown how the spring clip operates to engage a button type projection. The projection includes a button 122 having an outer portion 124 and a smaller inner portion 126. There may typically be formed a reduced diameter section between the portions 124, 126. The button 122 will be snap fit within the lower bowed portion 28, 30. In pushing the button 122 between the lower bowed arm 28, 30 as shown by the arrow 130, the neck section 32, 34 of the spring clip will be spread apart, as shown by the arrows 132 so as to cause the fingers 44, 46 and the feet 40, 42 to spread. The button 122 will be securely seated between the side walls 28, 30 of the lower bowed portion and the notched section 94 formed in the encasement member 70.

It should be appreciated, that the closed pocket 76 is such as to accommodate movement of the fingers 44, 46 both between the spread and the biased positions, as shown in FIGS. 7 and 8. However, at the same time, it closes off the fingers to avoid their grasping or snagging of the garment during their operation. Furthermore, it will be appreciated that curved edges and notches are now provided so as to avoid sharp points on the encasement member which would otherwise serve to mar the garment or harm the user during operation.

There has been disclosed heretofore the best embodiment of the invention presently contemplated. However, it is to be understood that various changes and modifications may be made thereto without departing from the spirit of the invention.

I claim:

1. A spring clip closure member for resilient clamping onto a button type projection, said closure member comprising a generally inverted U-shaped resilient wire loop having a bight portion for depending suspension from a support band, and pair of opposing leg portions each terminating in inwardly directed feet portions formed with downwardly directed finger portions, said feet portions being resiliently separable and normally spring biased toward each other to engage the button type projection, encasement means including a closed pocket for receiving and enveloping said downwardly directed finger portions and being dimensioned to permit resilient lateral movement of said finger portions, side channels defining passageways through which said feet portions extend as they separate, and stop walls integral with said closed pocket for limiting the lateral movement of said finger portions, wherein said encasement means is developed from an elongated substantially planar sheet of rigid material having a transverse axis and being symmetrically folded about said transverse axis, said encasement means including contoured opposing wall shaving undercut shoulders at lateral corners thereof, U-shaped planar extensions, and flange portions along the undercut shoulders, said flange portions abutting against each other and in their abutting relationship defining said side channels.

2. A spring clip closure member as in claim 1, wherein the corners of said opposing walls are angled, and lateral ends of said U-shaped extensions terminate at said angled corners, whereby said encasement means has notched indents at the juncture of said leg portions with said feet portions.

3. A spring clip closure member as in claim 1, wherein said encasement means further comprises a central aperture, and a notch along each side edge coaxial with said transverse axis.

4. A spring clip closure member as in claim 3, wherein the central aperture comprises smooth peripheral edges.

5. A spring clip closure member as in claim 1, wherein said leg portions form an hourglass configuration including upper and lower bowed sections, the lower bowed section engaging the button type projection.

6. A spring clip closure member as in claim 5, wherein said encasement means has a notched upper end for cooperating with said lower bowed section in engaging the button type projection.

7. A spring clip closure member as in claim 1, wherein said encasement means is of a one piece construction.

* * * * *